US005568674A

United States Patent [19]

Harada et al.

[11] Patent Number: 5,568,674

[45] Date of Patent: Oct. 29, 1996

[54] SLIDER FOR SLIDE FASTENER

[75] Inventors: Jiro Harada; Tsutomu Tomita; Hideo Takabatake, all of Toyama-ken, Japan

[73] Assignee: YKK Corporation, Tokyo, Japan

[21] Appl. No.: 563,941

[22] Filed: Nov. 29, 1995

[30] Foreign Application Priority Data

Nov. 30, 1994 [JP] Japan ..... 6-296242

[51] Int. Cl.[6] ..... A44B 19/00

[52] U.S. Cl. ..... 24/429; 24/419

[58] Field of Search ..... 24/429, 419, 437, 24/420, 425, 430, 434; 294/3.6

[56] References Cited

U.S. PATENT DOCUMENTS

| | | | |
|---|---|---|---|
| 2,968,078 | 1/1961 | Huelster | 24/419 |
| 3,597,810 | 8/1971 | Ilotte | 24/419 |
| 3,789,466 | 2/1974 | Watanabe | 24/419 |

FOREIGN PATENT DOCUMENTS

| | | | |
|---|---|---|---|
| 0701881 | 1/1965 | Canada | 24/419 |
| 1066874 | 4/1967 | United Kingdom . | |
| 1397516 | 6/1975 | United Kingdom . | |

*Primary Examiner*—Victor N. Sakran
*Attorney, Agent, or Firm*—Hill, Steadman & Simpson

[57] ABSTRACT

In a slide fastener slider, an attachment lug stands from a slider body and has a pair of support projections facing each other, defining a recess for receiving a pintle of a pull tab. The lug additionally has opposite reinforcing projections situated outside the respective support projections. For assembly, the support projections are bent toward the recess by pressing, and at the same time, the reinforcing projections are bent against the associated support projections to seal and hold the pintle of the pull tab. As the pintle of the pull tab is thus attached to the attachment lug reliably, the lug is adequately durable against any movement of the pull tab.

16 Claims, 8 Drawing Sheets

SLIDER FOR SLIDE FASTENER

BACKGROUND OF THE INVENTION

1. Field of the Invention

This invention relates to a slider for slide fasteners, and more particularly to a pull tab attachment mechanism, for various kinds of slide fastener sliders, with which a pull tab for closing and opening the slide fastener can be attached to a slider body reliably and firmly.

2. Description of the Related Art

In one known type of a pull tab attachment mechanism for attaching a pull tab to a slider body of a slide fastener in a simple way, as shown in FIG. 14 of the accompanying drawings, a pair of taper projections 8*a*, 8*a* standing from an upper surface of the slider body la are calked at their tips after a pintle of the pull tab (not shown) has been inserted into the inter-projection space.

In another known type of an attachment mechanism, as shown in FIG. 15, a hook-shape pull tab attachment lever 8*b* standing obliquely from the upper surface of the slider body is pressed against the slider body 1*b* after a pintle of the pull tab (not shown) has been inserted into the space between the slider body 1*b* and the attachment lever. According to the first-named known art, when the taper projections 8*a*, 8*a* are calked, the bases of the taper projections 8*a*, 8*a* do not deform, and only their tips deform to hold the pintle of the pull tab. So, in use, the tip of tile taper projections 8*a*, 8*a* tend to be split apart due to the pulling action of the pull tab, allowing the pull tab to be removed off the slider body 1*a*.

Further, according to the second-named known art, when the attachment lever 8*b* is calked on the slider body 1*b*, its entire body has to be pressed against the slider body 1*b* so that a great load is exerted on the base of the attachment lever 8*b*. As a result, cracks tend to be made in the base, so that the slider, especially a small-size slider can be easily broken.

SUMMARY OF THE INVENTION

It is therefore an object of this invention to provide a slide fastener slider in which a pull tab can be attached to a slider body without difficulty and is prevented from accidental removal from an attachment lug as the latter is free from opening due to the pulling action of the pull tab and in which, when tile pull tab is attached to the attachment lug on the slider body, concentrated load due to the calking of the lug is decreased.

In order to accomplish the above object, according to a first aspect of the invention, there is provided a slide fastener slider comprising: a slider body; a pull tab pivotally attached to the slider body and having a pintle; and a pull tab attaching lug projecting from a surface of the slider body and having a recess adapted to receive the pintle of the pull tab, a first support projection adapted to be bent toward the recess, a second support projection, and at least a first reinforcing projection extending parallel to the first support projection and adapted to be bent against the first support projection. The first support projection and the second projection are situated facing each other with the recess defined therebetween.

Preferably, the lug has a second reinforcing projection, and the second support projection and the second reinforcing projection are identical with the first support projection and the first reinforcing projection, respectively. Alternatively, the second support projection may be a non-deformable support column.

The first projections and the second projections of the pull tab attaching lug are arranged in a longitudinal direction of the slider body. Alternatively, the first projections and the second projections of the pull tab attaching lug are arranged in parallel in a transverse direction of said slider body.

Preferably, the recess has a bottom whose level is over an outer surface of an upper or lower wing of the slider body.

Further, at least the first support projection is larger in height than at least the first reinforcing projection and has on its outer surface an engaging portion engageable with a distal end of at least the reinforcing projection when the reinforcing projection is bent against the support projection.

Furthermore, at least the first support projection and at least the first reinforcing projection have, on their respective outer surfaces, sloping taper surfaces.

Further, at least the first support projection or at least the reinforcing projection has a notch extending longitudinally of the lug dividing each support or reinforcing projection into longitudinal halves.

Furthermore, at least the first projection and at least the first reinforcing projection have opposite sloping side surfaces each gradually decreasing in width and thickness from base to end.

According to a second aspect of the invention, there is provided a slide fastener slider comprising a slider body; a pull tab pivotally attached to the slider body and having a pintle; and first and second pull tab attaching lugs projecting from a surface of the slider body and arranged in parallel in a transverse direction of the slider body, the first pull tab attaching lug having first and second support projections, first and second reinforcing projections, and a first recess adapted to receive one end of the pintle, the second pull tab attaching lug having third and fourth support projections, third and fourth reinforcing projections, and a second recess adapted to receive the other end of the pintle (7). The first and second support projections are situated facing each other with said first recess defined therebetween, and adapted to be bent toward the first recess, while the third and fourth support projections are also situated facing each other with said second recess defined therebetween, and adapted to be bent toward the second recess. Further, the first and second reinforcing projections extend parallel to and are adapted to be bent against the first and second support projections respectively, while the third and fourth reinforcing projections also extend parallel to and are adapted to be bent against the third and fourth support projections respectively, The first pull tab attaching lug and the second pull tab attaching lug are arranged in parallel in a transverse direction of the slider body in such a manner that the first and second projections of the first lug, and the third and fourth projections of the second lug of the second lug are arranged in a longitudinal direction of the slider body in parallel in a longitudinal direction of said slider body. Alternatively, the first pull tab attaching lug and the second pull tab attaching lug are arranged in parallel in a longitudinal direction of the slider body in such a manner that the first and second projections of the first lug, and the third and fourth projections of the second lug are arranged in a transverse direction of the slider body in parallel in a transverse direction of the slider body.

Preferably, each of the first and second recesses has a bottom whose level is over an outer surface of an upper or lower wing of said slider body.

Further, each of the support projections is larger in height than each of said reinforcing projections and has on its outer surface an engaging portion engageable with a distal end of the reinforcing projection the reinforcing projection is bent against the support projection.

Furthermore, each of the support projections and each of the reinforcing projection have, on their respective outer surfaces, sloping taper surfaces.

Furthermore, each of the support projections or each of the reinforcing projections has a notch extending longitudinally of each of the lugs dividing each of the support or reinforcing projections into longitudinal halves.

Further, each of the support projections and each of the reinforcing projections have opposite sloping side surfaces each gradually decreasing in width and in thickness from base to end.

For assembly, after the pintle of the pull tab is inserted into the first recess that is defined between the first and second support projections of the pull tab attachment lug standing on the upper or lower wing of the slider body, or between the first support projection and the support column, the first and/or second support projections are calked and bent toward the recess by pressing, and at the same time, the first and/or second reinforcing projections are bent against the respective support projections, so that the pintle of the pull tab are pivotally sealed and received in the lug. Thus the pull tab has been attached to the slider body.

FIGS. 1 through 8 show a lock-free slider that is freely slidable in whichever direction the pull tab is pulled. FIG. 9 and 10 show a lock slider, which has a locking pawl; the slider is slidable when the pull tab is raised by at least 45°.

FIG. 11 shows an automatic lock slider with a spring having a locking pawl; the slider is freely slidable when the pull tab is raised by at least 45°. When the pull tab is released from the pulling force, the locking pawl comes into an inter-element space under the elasticity of the spring, thus automatically stopping the slider.

FIG. 12 shows a double-faced slider, in which pull tabs are attached to the respective attachment rugs on upper and lower wings; the slider is slidable whichever pull tab is pulled and can therefore be used in a camping tent. FIG. 13 shows a transverse-type slider in which a pull tab attachment lug extends transversely on the upper surface of the slider body. The transverse slider can therefore be used in a pocket of a garment, a clothing case, etc.

DETAILED DESCRIPTION OF THE PREFERRED EMBODIMENTS

Figure 1:
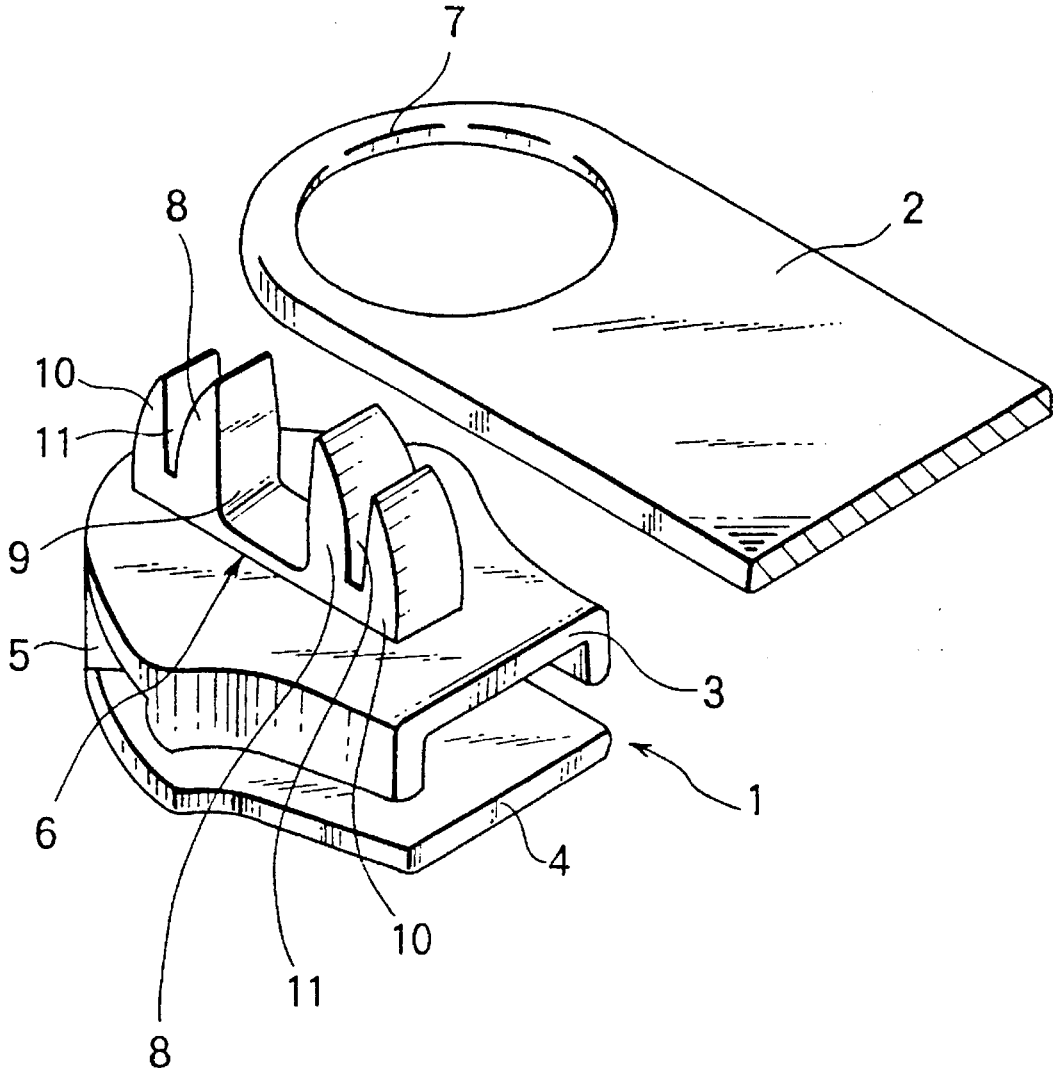
FIG. 1 is an exploded perspective view of a slide fastener slider according to an embodiment of this invention.

Various preferred embodiments of a slide fastener slider of this invention will now be described in detail with reference to the accompanying drawings.

The slide fastener slider comprises a die-cast metal slider body 1 and a pull tab 2 attached to the slider body 1. The slider body 1 includes upper and lower wings 3, 4 connected together by a central guide 5. The wing 3 or 4 has on its surface a pull tab attachment lug 6.

Figure 2:
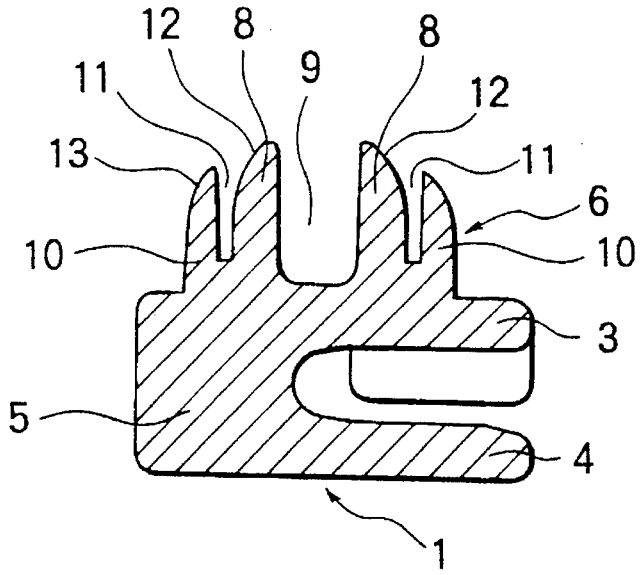
FIG. 2 is a longitudinal cross-sectional view of a slider body of the slider.

The pull tab attachment lug 6, as shown in FIGS. 1 and 2, has on the surface of the upper wing 3 a pair of support projections 8 opposed longitudinally of the slider body 1, between which a recess 9 is defined. The recess 9 has a bottom whose level is higher than the surface of the upper wing 3, and which is formed so as to receive a pintle of the pull tab 2.

Outside the front and rear support projections 8, 8, there are front and rear reinforcing projections 10, 10, each defining, together with the respective support projection 8, a groove 11 which is smaller in depth than the recess 9. The reinforcing projections 10, 10 are smaller in height than the support projections 8, 8. Each of the support projections 8, 8 or each of the reinforcing projections 10, 10 has on the outer side of the tip or distal end a taper surface 12, 13. The support and reinforcing projections 8, 8; 10, 10 are bendable inwardly, i.e., toward the recess 9.

Figure 3:
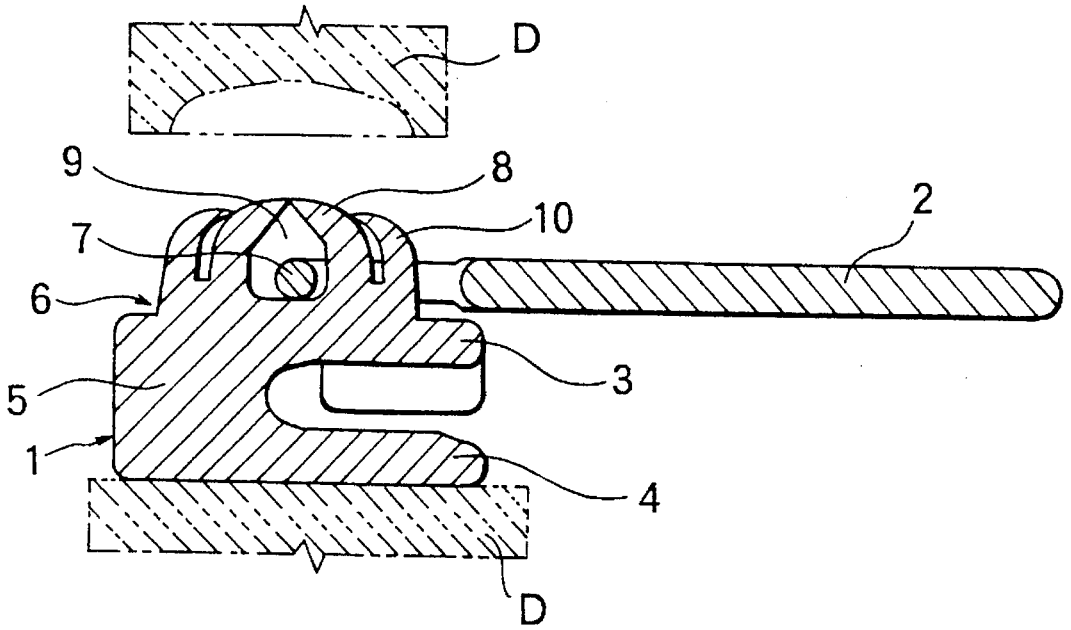
FIG. 3 is a longitudinal cross-sectional view of the slider, showing the manner in which a pull tab attachment lug is calked by pressing.

For attaching the pull tab 2 to the pull tab attachment lug 6, as shown in FIG. 3, the slider body 1 is placed on a lower die D of a pressing machine, and the pintle 7 of the pull tab 2 is inserted through the recess 9 of the pull tab attachment lug 6, whereupon the support and reinforcing projections 8, 8; 10, 10 are bent toward the recess 9 by the lowering and pressing action of an upper die D so that their tips are clenched to hold the pintle 7 of the pull tab 2, thus attaching the pull tab 2 to the pull tab attachment lug 6. At that time, each reinforcing projection 10 is pressed against the outside surface of the associated support projection 8 so that the support projection 8 is prevented from deforming outwardly and is hence is fixed in a reinforced state.

Figure 4:
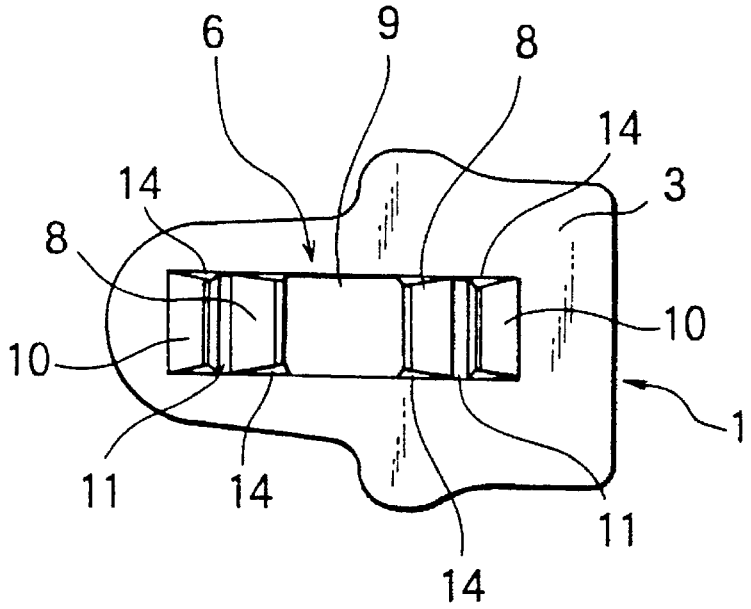
FIG. 4 is a plan view of the slider body.
Figure 5:
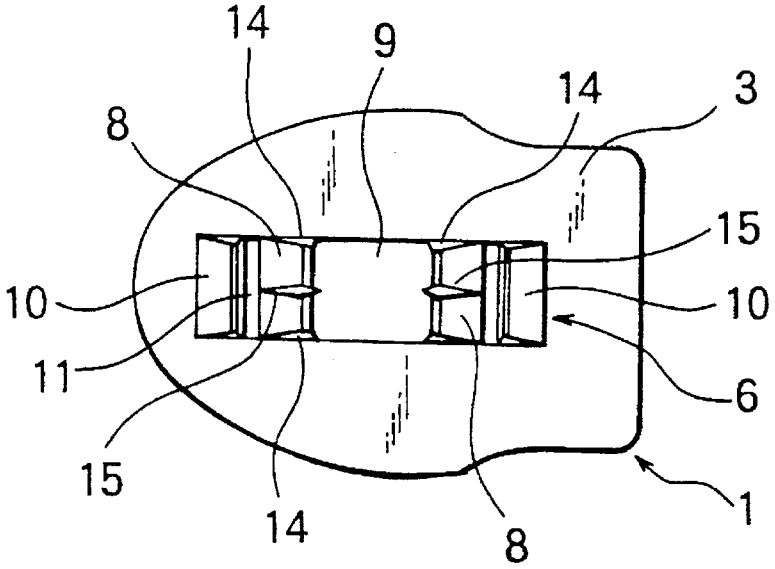
FIG. 5 is a plan view of a modified slider body, in which each of opposite support projections of the pull tab attachment lug has a central notch.

Each of the support and reinforcing projections 8, 8; 10, 10, as shown in FIG. 4, has opposite sloping side surfaces 14 each gradually decreasing in width and thickness from its base toward its tip. Further, as shown in FIG. 5, each support projection 8 has a central notch 15 extending longitudinally of the slider body 1 and can hence be easily deformed by pressing. The width of each support or reinforcing projection indicates a length of the projection in a transverse direction of the slider body, while the thickness indicates a length of the projection in the longitudinal direction.

Figure 6:
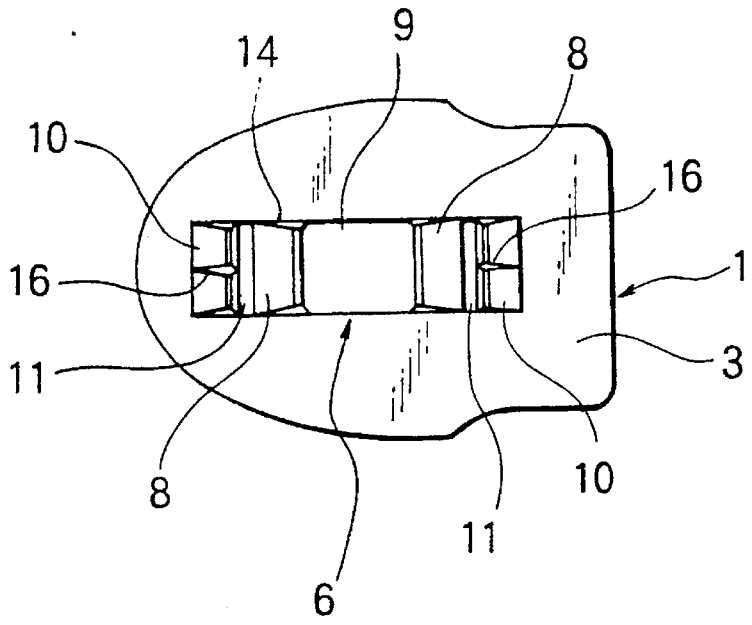
FIG. 6 is a plan view of another modified slider body, in which each of opposite reinforcing projections of the pull tab attachment lug has a central notch.

Alternatively, as shown in FIG. 6, each reinforcing projection 10 may have a central notch 16 extending longitudinally of the slider body 1. Further, more than one notch 15, 16 may be formed in each of the projections longitudinally of the slider body 1.

Figure 7:
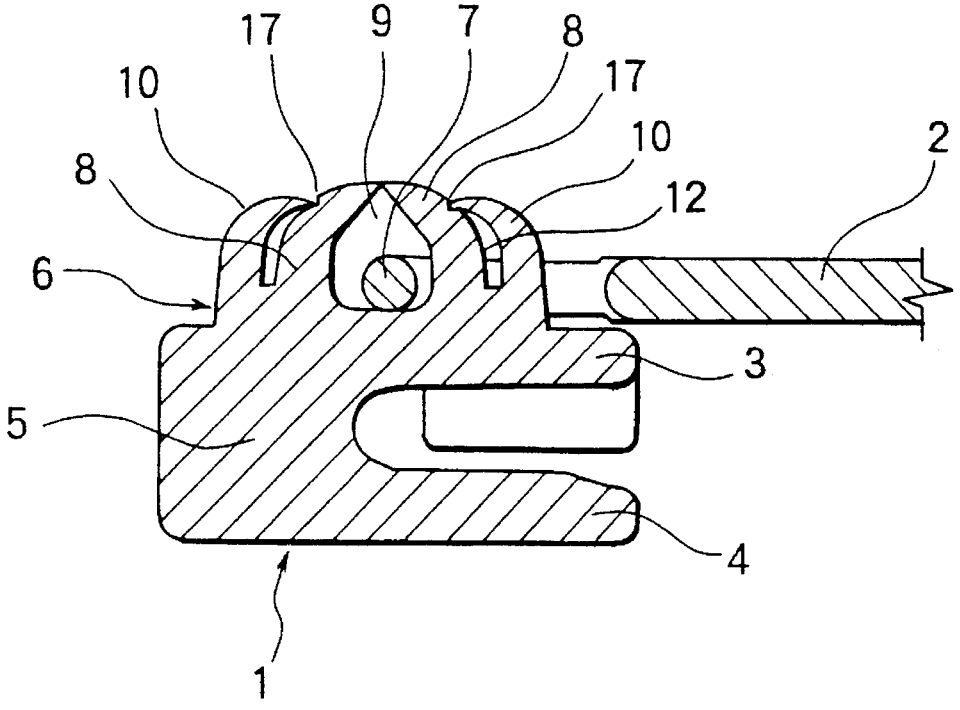
FIG. 7 is a longitudinal cross-sectional view of still another modified slider body, in which each of opposite support projections has an engaging portion engageable with the tip of the respective reinforcing projection.

In FIG. 7, each support projection 8 has on its outer surface at a position toward the tip a stepped engaging portion 17 that is engageable with the tip of the associated reinforcing projection 10 when the latter is bent. The engaging portion 17 may be in the form of a ledge or a groove.

Figure 8:
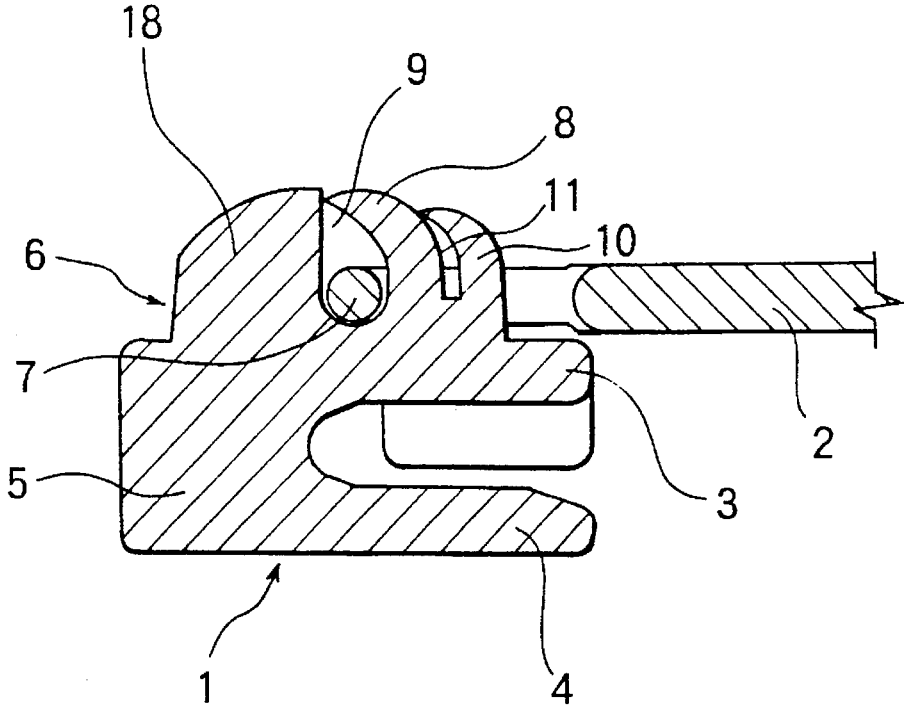
FIG. 8 is a longitudinal cross-sectional view of a modified slider having a cantilevered pull tab.

In FIG. 8, the pull tab attachment lug 6 has a non-deformable support column 18 standing from the upper wing 3 of the slider body 1 at a position toward the front end of the slider body 1, i.e. on the upper side of the central guide 5. A rear support projection 8 and a rear reinforcing projection 10 are situated in confronting relationship with the support column 18 with the recess 9 defined therebetween. In the pull tab attachment lug 6, the rear support and reinforcing projections 8, 10 are bent against the support column 18 to hold the pintle 7 of the pull tab 2 in the recess 9, thus attaching the pull tab 2 to the slider body 1 to complete a cantilevered slider.

Figure 9:
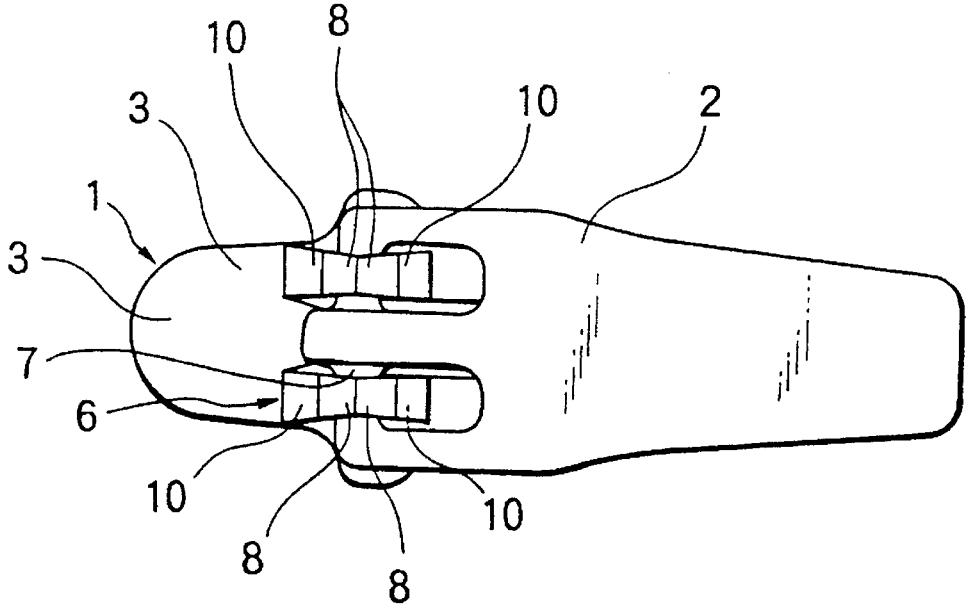
FIG. 9 is a plan view of a lock slider.
Figure 10:
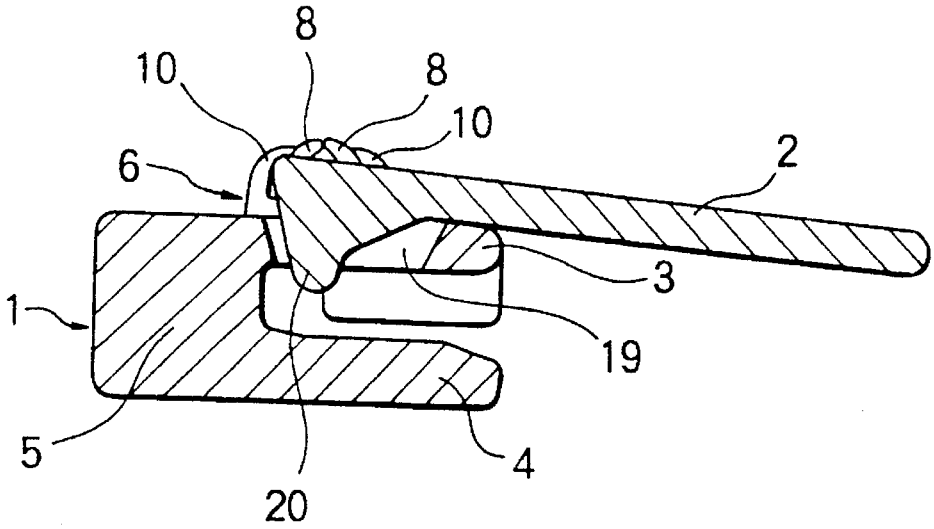
FIG. 10 is a longitudinal cross-sectional view of the lock slider of FIG. 9.

In FIG. 9, a pair of pull tab attachment lugs 6 transversely arranged on the upper wing 3 of the slider body 1 and defining between them a pawl aperture 19 in which a pull tab 2 having a central locking pawl 20 is mounted as shown in FIG. 10, thus completing a lock slider.

Figure 11:
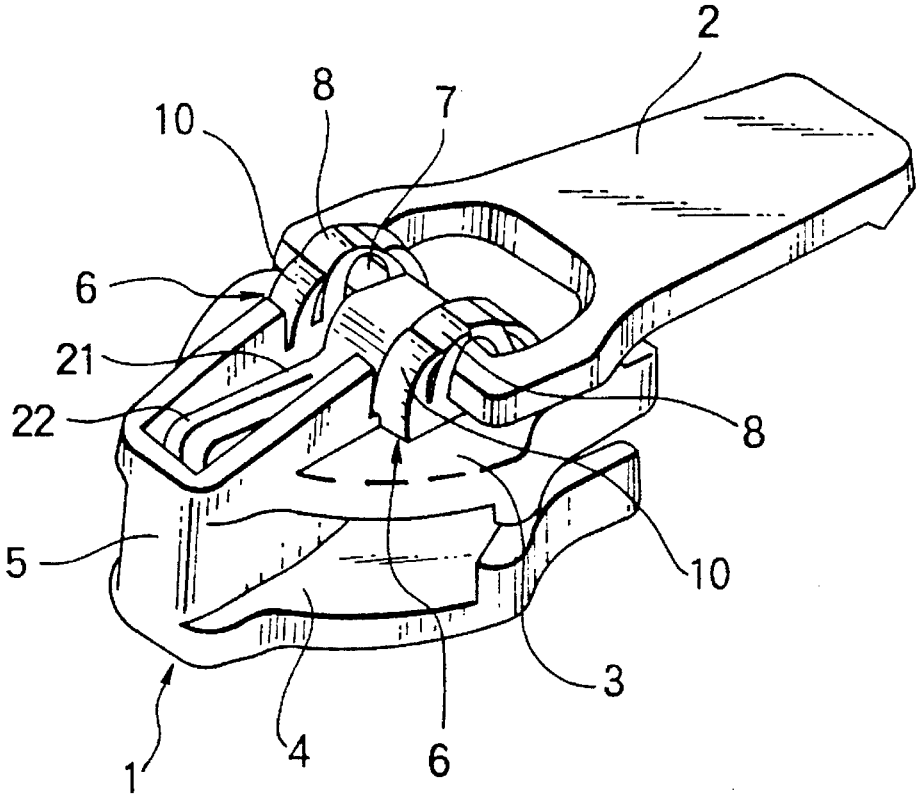
FIG. 11 is a perspective view of an automatic lock slider.

Similarly, in FIG. 11, a pair of pull tab attachment lugs 6 transversely arranged on the upper wing 3 of the slider body 1 and defining between them a pawl aperture 21. But here, a spring 22 having a locking pawl is mounted in the pawl aperture 21; the pintle 7 of the pull tab 2 serves as a cam to move the locking pawl into and out of a Y-shape coupling-element guide channel of the slider body 1 in response to the pivotal movement of the pull tab 2.

Figure 12:
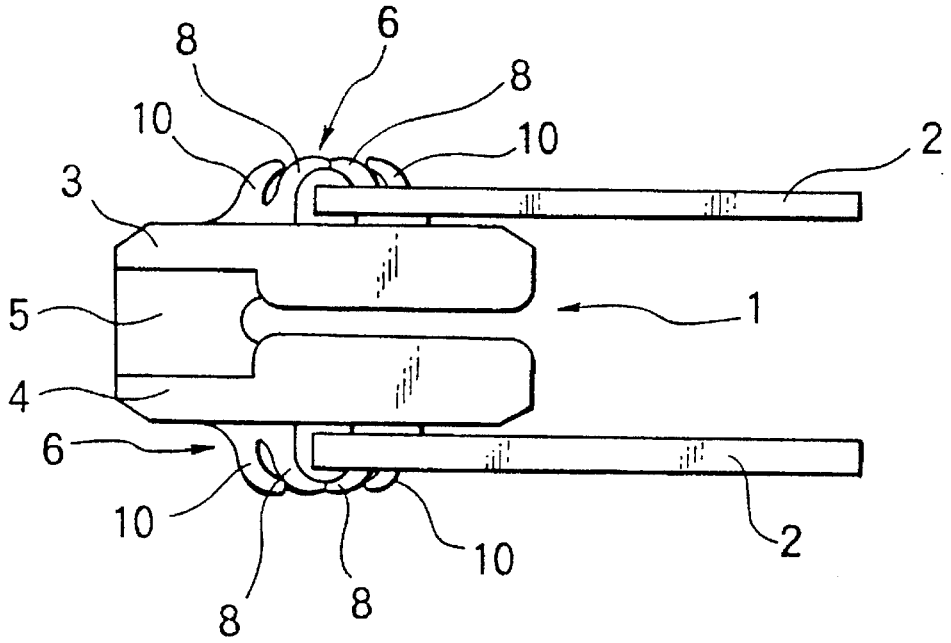
FIG. 12 is a side view of a double-faced slider.
Figure 13:
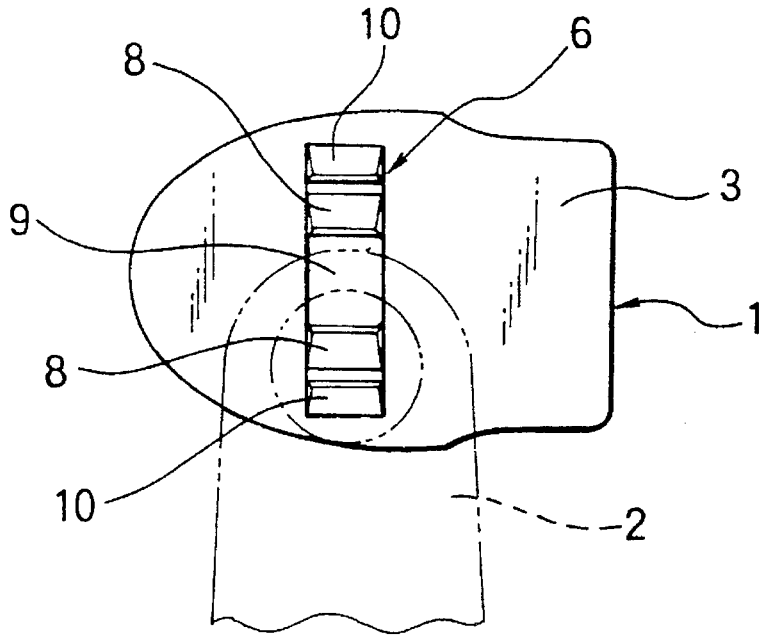
FIG. 13 is a plan view of a transverse-type slider.
Figure 14:
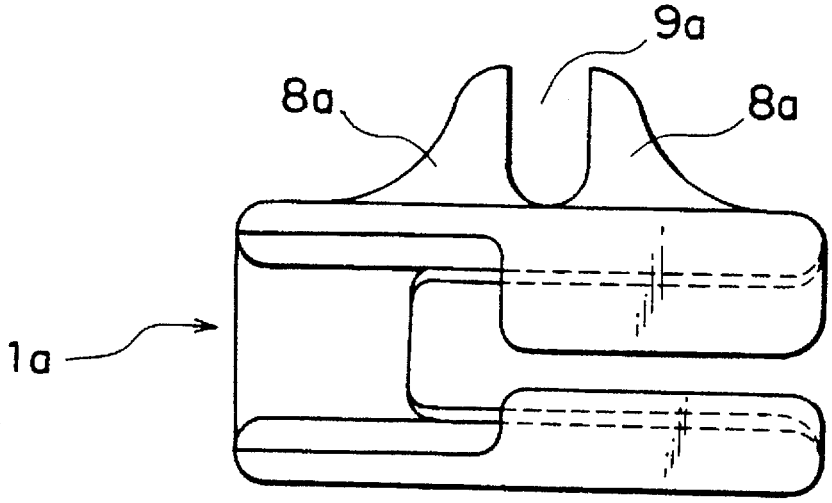
FIG. 14 PRIOR ART
FIG. 14 is a side view of a known slider body.
Figure 15:
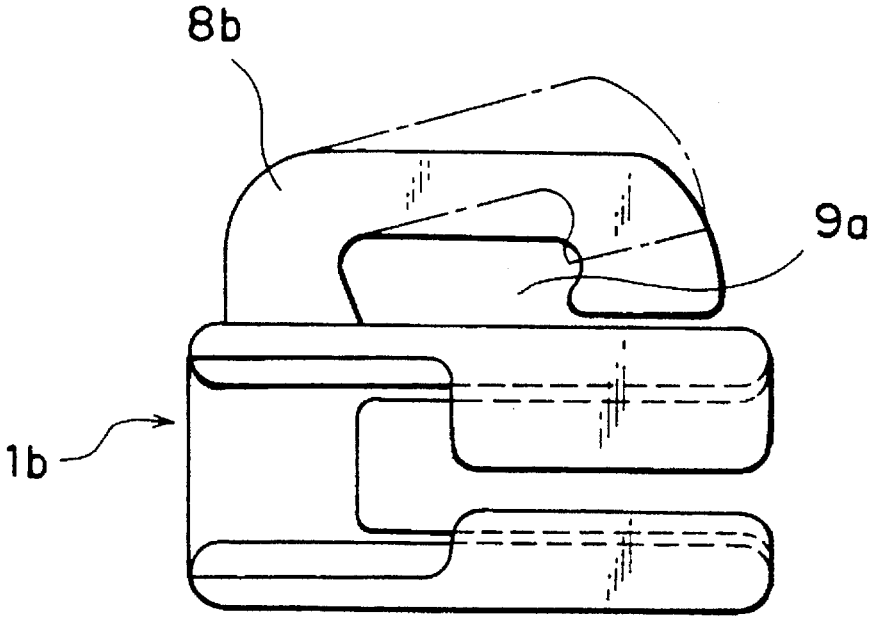
FIG. 15 PRIOR ART
FIG. 15 is a side view of another known slider body.

Further, in FIG. 12, a pair of pull tab attachment lugs 6 stands respectively from the surface of each of the upper and lower wings 3, 4, and a pair of pull tabs 2 are attached to the respective attachment lugs 6 to complete a double-faced slider. In FIG. 13, the pub tab attachment lug 6 is placed transversely on the surface of the upper wing 3 of the slider body 1, and the pull tab 2 is attached to the attachment lug 6 to complete a transverse-type slider.

Apart from the foregoing embodiments, a plurality of reinforcing projections 10 may be provided on the upper or lower wings 3, 4 of the slider body 1, longitudinally of the pull tab attachment lug 6 to increase the strength of the attachment lug 6. With the pull tab attachment structure of the slide fastener slider of this invention, it is possible to obtain the following advantageous results:

According to the slide fastener slider of this invention, the pull tab attachment lug 6 on the slider body 1 has a recess 9 for receiving the pintles of the pull tab 2, the recess 9 is defined by opposite support projections 8, 8 bendable toward the recess 9, and opposite reinforcing projections 10, 10 are arranged parallel to the respective support projections 8, 8 and bendable toward the recess 9. During pressing to hold the pintle 7 of the pull tab 2 in the pull tab attachment lug 6, since concentrated load can be distributed to the support projections 8, 8 and the reinforcing projections 10, 10, an effective calking result can be achieved with only a limited amount of deformation. Partly since the pull tab attachment lug 6 is free from cracks or other damages and partly since the support projections 8, 8 are protected and reinforced by the reinforcing projections 10, 10, it is possible to make the pull tab attachment lug 6 adequately durable against any movement of the pull tab 2 so that the resultant slider can be used for a long time. The front set of support and reinforcing projections 8, 10 may be situated in confronting relationship with the rear set of support and reinforcing projections 8, 10 with the recess 9 defined therebetween, or one set of support and reinforcing projections may be situated on one side of the recess for a cantilevered slider, this invention can be applied to various types of sliders, thus causing an increased range of application.

Since the bottom of the recess 9 has a level higher than the surface of the wing of the slider body 1, it is possible to attach and hold the pull tab 2 reliably. Further, since the support and reinforcing projections 8, 10 define between them a groove 11 which is smaller in depth than the recess 9, it is possible to facilitate calking the support and reinforcing projections 8, 10. Further, the support and reinforcing projections 8, 10 are integral with each other at base and have hence an improved degree of toughness so that the resulting slider is durable against any movement of the pull tab 2.

Further, since each support projection 8 is larger in height than the associated reinforcing projection 10, it is possible to clench the support projections 8, 8 firstly and then the reinforcing projections 10, 10 so that easy and reliable calking can be achieved. Having a taper surface on the outer side of the distal end portion respectively, these projections 8, 10 can be inwardly bent easily and reliably.

Since each support or reinforcing projection 8, 10 has a central notch extending longitudinally of the slider body 1 and dividing the projection 8 or 10 into transverse halves, it is possible to facilitate calking work. Further, since each support projection 8 has in its outer surface an engaging portion 17 engageable with the tip of the associated reinforcing projection 10, it is possible to join the support and reinforcing projections 8, 10 together reliably to reinforce the support projections 10, 10 so that the pull tab attachment lug 6 can be adequately durable against any movement of the pull tab 2.

What is claimed is:

1. A slide fastener slider comprising:

(a) a slider body;

(b) a pull tab pivotally attached to said slider body and having a pintle; and (c) a pull tab attaching lug projecting from a surface of said slider body and having a recess adapted to receive said pintle of said pull tab, a first support projection adapted to be bent toward said recess, a second support projection, and at least a first reinforcing projection extending parallel to said first support projection and adapted to be bent against said first support projection, said first support projection and said second projection being situated facing each other with said recess defined therebetween.

2. A slide fastener slider according to claim 1, wherein said lug bas a second reinforcing projection, said second support projection and said second reinforcing projection being identical with said first support projection and said first reinforcing projection, respectively.

3. A slide fastener slider according to claim 1, wherein said second support projection is a non-deformable support column.

4. A slide fastener slider according to claim 1, wherein said first projections and said second projections of said pull tab attaching lug are arranged in parallel in a transverse direction of said slider body.

5. A slide fastener slider according to claim 1, wherein said recess has a bottom whose level is over an outer surface of an upper or lower wing of said slider body.

6. A slide fastener slider according to claim 1, wherein at least said first support projection is larger in height than said at least first reinforcing projection and has on its outer surface an engaging portion engageable with a distal end of said at least first reinforcing projection when said reinforcing projection is bent against said support projection.

7. A slide fastener slider according to claim 1, wherein said at least first support projection and said at least first reinforcing projection have, on their respective outer surfaces, sloping taper surfaces.

8. A slide fastener slider according to claim wherein said at least first support projection or said at least reinforcing projection has a notch extending longitudinally of said lug dividing said each support or each reinforcing projection into longitudinal halves.

9. A slide fastener slider according to claim 1, wherein said at least first projection and said at least first reinforcing projection have opposite sloping side surfaces each gradually decreasing in width and thickness from base to end.

10. A slide fastener slider comprising:

(a) a slider body;

(b) a pull tab pivotally attached to said slider body and having a pintle; and (c) first and second pull tab attaching lugs projecting from a surface of said slider body and arranged in parallel on said slider body, said first pull tab attaching lug having first and second support projections, first and second reinforcing projections, and a first recess adapted to receive one end of said pintle, said second pull tab attaching lug having third and fourth support projections, third and fourth reinforcing projections, and a second recess adapted to receive the other end of said pintle, (d) said first and second support projections situated facing each other, defining said first recess therebetween, and adapted to be bent toward said first recess, said third and fourth support projections situated facing each other, defining said second recess therebetween, and adapted to be bent toward said second recess, (e) said first and second reinforcing projections extending parallel to and adapted to be bent against said first and second support projections respectively, said third and fourth reinforcing projections extending parallel to and adapted to be bent against said third and fourth support projections respectively.

11. A slide fastener slider according to claim 10, wherein said first pull tab attaching lug and said second pull tab attaching lug are arranged in parallel in a longitudinal direction of said slider body in such a manner that said first and second projections of said first lug, and said third and fourth projections of said second lug are arranged in a transverse direction of said slider body.

12. A slide fastener slider according to claim 10, wherein each of said first and second recesses has a bottom whose level is over an outer surface of an upper or lower wing of said slider body.

13. A slide fastener slider according to claim 10, wherein each of said support projections is larger in height than each of said reinforcing projections and has on its outer surface an engaging portion engageable with a distal end of said each reinforcing projection when said each reinforcing projection is bent against said each support projection.

14. A slide fastener slider according to claim 10, wherein said each support projection and said each reinforcing projection have, on their respective outer surfaces, sloping taper surfaces.

15. A slide fastener slider according to claim 10, wherein said each support projection or said each reinforcing projection has a notch extending longitudinally of each said lug dividing said each support or said each reinforcing projection into longitudinal halves.

16. A slide fastener slider according to claim 10, wherein said each said support projection and said each reinforcing projection have opposite sloping side surfaces each gradually decreasing in width and in thickness from base to end.

* * * * *

UNITED STATES PATENT AND TRADEMARK OFFICE

CERTIFICATE OF CORRECTION

PATENT NO. : 5,568,674
DATED : October 29, 1996
INVENTOR(S) : Harada et al.

It is certified that error appears in the above-identified patent and that said Letters Patent is hereby corrected as shown below:

In column 7, line 11, claim 8 should read:

A slide fastener slider according to claim 1, wherein said

Signed and Sealed this

Thirty-first Day of August, 1999

*Attest:*

Q. TODD DICKINSON

*Attesting Officer*

*Acting Commissioner of Patents and Trademarks*